United States Patent [19]

Vetter

[11] Patent Number: 4,497,135

[45] Date of Patent: Feb. 5, 1985

[54] AUTOMATIC OPERATOR AND LOCKING MECHANISM FOR A CLOSURE

[75] Inventor: Gregory J. Vetter, Owatonna, Minn.

[73] Assignee: Truth Incorporated, Owatonna, Minn.

[21] Appl. No.: 441,547

[22] Filed: Nov. 15, 1982

[51] Int. Cl.[3] ..... E05F 15/00

[52] U.S. Cl. ..... 49/280; 49/252

[58] Field of Search ..... 49/280, 300, 340, 341, 49/342, 252

[56] References Cited

U.S. PATENT DOCUMENTS

| | | | |
|---|---|---|---|
| 1,724,011 | 8/1929 | Flagg . | |
| 2,136,812 | 11/1938 | Carnahan | 268/117 |
| 2,256,613 | 9/1941 | Forman et al. | 268/65 |
| 2,366,613 | 1/1945 | Hagstrom | 268/120 |
| 2,538,980 | 1/1951 | Payne, Jr. | 268/75 |
| 3,081,078 | 3/1963 | Lohr | 268/74 |
| 3,145,988 | 8/1964 | Colautti et al. | 268/3 |
| 3,154,302 | 10/1964 | Maruyama | 268/3 |
| 3,202,414 | 8/1965 | Simmons et al. | 268/3 |
| 3,274,732 | 9/1966 | Murakami | 49/280 |
| 3,653,154 | 4/1972 | Hayday | 49/280 |
| 4,333,269 | 6/1982 | Bascou | 49/280 |

*Primary Examiner*—Kenneth Downey

*Attorney, Agent, or Firm*—Wood, Dalton, Phillips, Mason & Rowe

[57] ABSTRACT

An automatic operator and locking mechanism for a casement window or the like having window locking structure including a movable tie bar which is moved to both lock and unlock the window, a window hinge mounting the window for opening and closing movement, an operator arm operatively connected to the window and a rotatable lead screw connected to the operator arm for movement thereof, planetary gearing having two alternately operable output connections structurally connected one to said tie bar and one to said lead screw, a motor for driving said planetary gearing and a trigger member for sensing the open or closed position of the window and operable when the window is open to hold the tie bar against movement whereby drive of the planetary gearing causes closing movement of the window.

16 Claims, 6 Drawing Figures

AUTOMATIC OPERATOR AND LOCKING MECHANISM FOR A CLOSURE

BACKGROUND OF THE INVENTION

This invention pertains to an automatic operator and locking mechanism for a closure and, more particularly, for a casement window or the like.

The prior art discloses various structures that have been designed for sequentially controlling the movement of a closure, such as a window, and a mechanism for locking and unlocking the window. These structures include a planetary gearing system for obtaining a sequential action. However, the structure is relatively complex and, in addition to a motor for driving the planetary gearing, requires mechanism operated by a solenoid and a special type of lock for the window. Additionally known are complicated mechanical structures which require the driving of a member for sequentially operating different link structures or require complex mechanism which appears to provide a lost motion connection. The prior art does not show planetary gearing arranged for positive drive in the proper sequence of window locking and window operating structure requiring only the control of a motor which drives the planetary gearing.

SUMMARY OF THE INVENTION

A primary feature of the invention disclosed herein is to provide an automatic operator and locking mechanism for a closure wherein the mechanism can be concealed within the conventional frame structure mounting the closure, such as a casement window, with the locking and unlocking of the window and opening and closing thereof occurring automatically, upon energization of a motor, with sufficient power available to open the window in a reasonable length of time.

In carrying out the foregoing, planetary gearing and a drive motor are located adjacent the window and the planetary gearing has two output connections structurally connected one to mechanism for opening and closing the window and the other to mechanism for locking and unlocking the window and with the correct sequence of operation occurring either because the window is locked or because trigger means engageable by a closed window sense the open position of the window and hold the window lock structure against movement whereby the window is caused to close upon operation of the planetary gearing.

An object of the invention is to provide an automatic operator and locking mechanism for a casement window or the like comprising means including a movable member for locking the window, means including a movable member for opening and closing the window, planetary gearing having two alternatively operable output connections structurally connected one to each of said members for powering the window open and closed and the movable member of the window locking means in window locking and unlocking movements, and a single power source for said mechanism.

Still another object of the invention is to provide an automatic operator and locking mechanism for a window comprising means mounting a window sash in a window frame for pivotal opening and closing movement, means for moving the window sash including an operator arm and a rotatable lead screw connected to said operator arm for moving the operator arm in response to lead screw rotation, means for locking the window sash in closed position including a tie bar movably mounted on the window frame, planetary gearing having two output connections one operatively connected to said lead screw and the other to said tie bar, a power source connected to an input gear of said planetary gearing, trigger means including a movable trigger member engageable by the window sash when the latter is closed and thereby held in a first position and having a second position when the window sash is open, and means on the trigger member coacting with a member movable with the tie bar for holding the tie bar and therefore one output connection of the planetary gearing against movement when the window sash is open and the trigger member is in said second position.

DESCRIPTION OF THE PREFERRED EMBODIMENT

Figure 1:
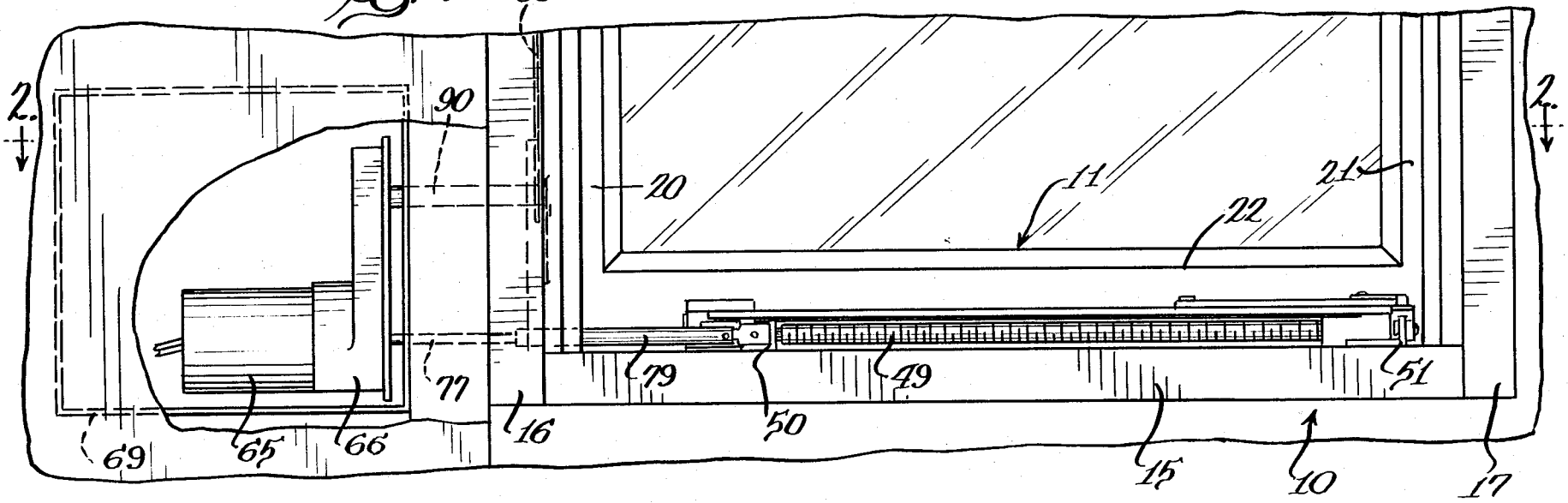
FIG. 1 is a fragmentary elevational view of a window in closed position showing the operating mechanism associated therewith and with parts broken away.
Figure 2:
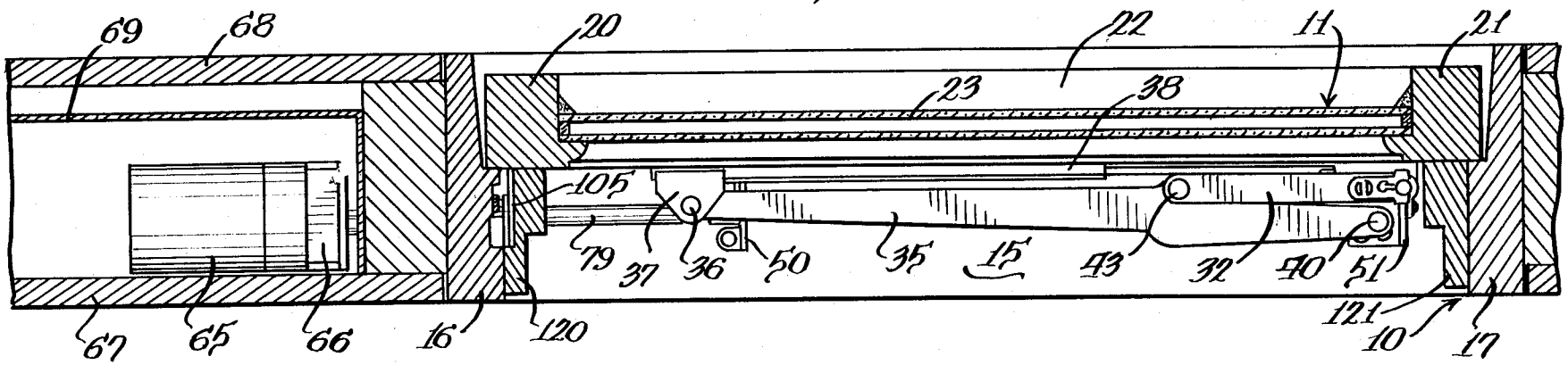
FIG. 2 is a sectional view, taken generally along the line 2—2 in FIG. 1.
Figure 3:
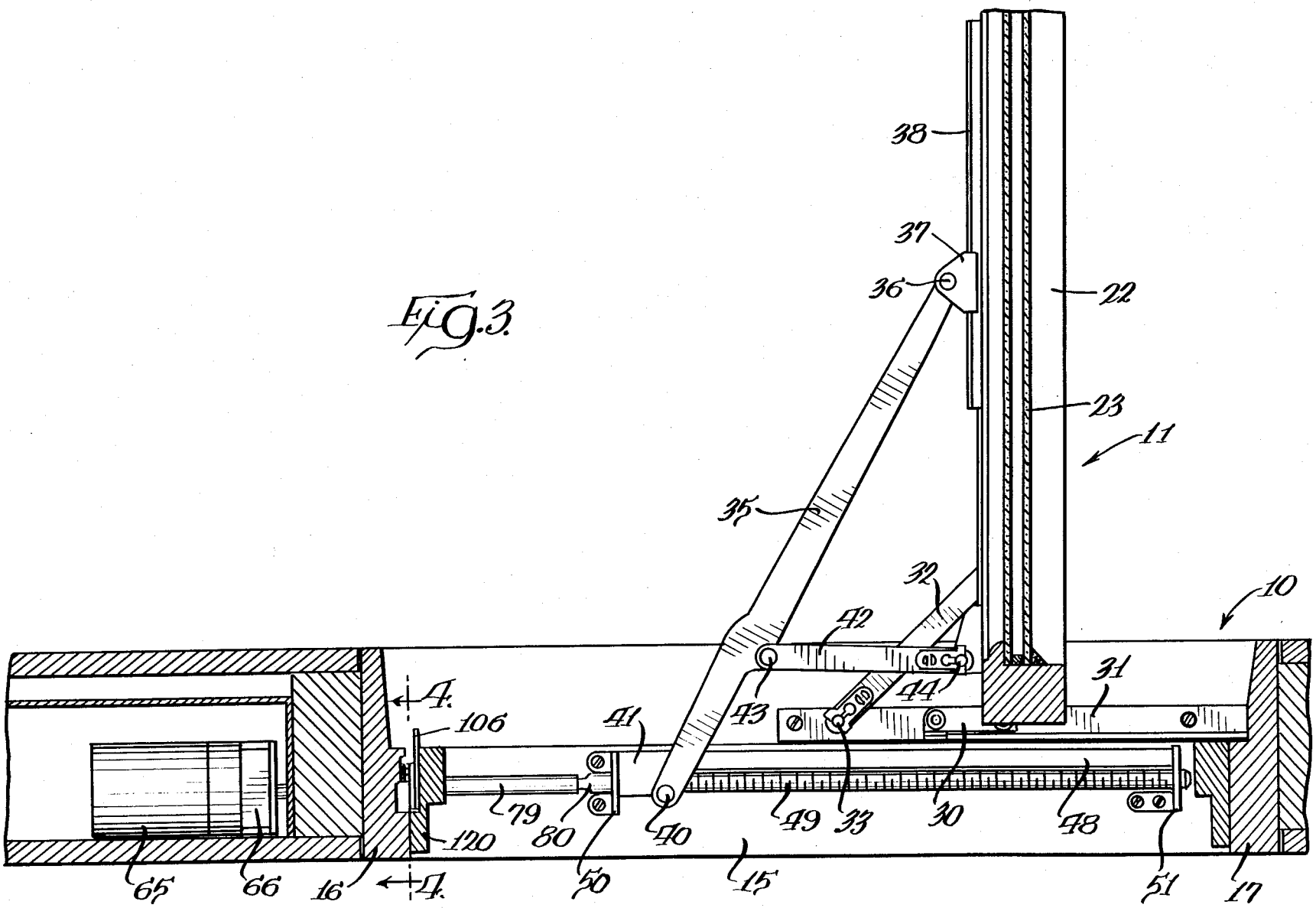
FIG. 3 is a view, similar to FIG. 2, showing the window fully open.

The automatic operator and locking mechanism for a closure which is disclosed herein is shown in association with a casement window which is movable between a closed position, shown in FIGS. 1 and 2, and an open position, with the fully open position being shown in FIG. 3. It will be obvious that, in addition to use of the invention with casement windows, it can be used with other types of windows, such as an awning window, as well as other closures.

The casement window has a window frame, indicated generally at 10, and a window sash, indicated generally at 11. The window frame is of conventional construction with the drawings illustrating a sill 15 and a pair of side jambs 16 and 17.

The window sash 11 has stiles 20 and 21 interconnected by a bottom rail 22 and a top rail (not shown) in which glass panels are mounted.

The window sash 11 is pivotally mounted on a guide block 30 which is movable along a guide track 31 mounted on the window sill 15. The guide block 30 and guide track 31 are part of a hinge mounting for the window sash which, additionally, includes a hinge arm 32 pivotally connected to the guide track 31 at 33 and pivoted to the underside of the sash rail 22. This hinge structure is of the type shown in Gill et al. U.S. Pat. No. 2,948,027 and the disclosure thereof is incorporated herein by reference.

Movement is imparted to the window by an operator arm 35 which is pivotally connected at 36 to a slide member 37 which slides along a guide track 38 fixed to the inner face of the sash rail 22. At the other end, the operator arm 35 is pivotally connected at 40 to a slider 41 which moves lengthwise of the window sill 15. A link 42 is pivotally connected to the operator arm intermediate the ends of the operator arm at 43 and at its opposite end is pivotally connected at 44 to the window sash near the connection of the latter to the window hinge.

The slider 41 for the operator arm is mounted for movement along a support bar 48 which extends parallel to a rotatable lead screw 49. The support bar 48 and lead screw 49 are supported above the window sill 15 by a pair of brackets 50 and 51 attached to the sill by suitable means, such as screws. The support bar 48 extends between and is fixed to the brackets 50 and 51 and the lead screw 49 is rotatably mounted in said brackets. Slider 41 has a pair of openings, with one opening receiving the support bar 48 and the other opening having threads which coact with the lead screw 49 whereby rotation of the lead screw causes linear movement of the slider 41 along the support bar 48.

The foregoing structure provides means mounting the window for opening and closing movement and means for opening and closing the window.

Figure 4:
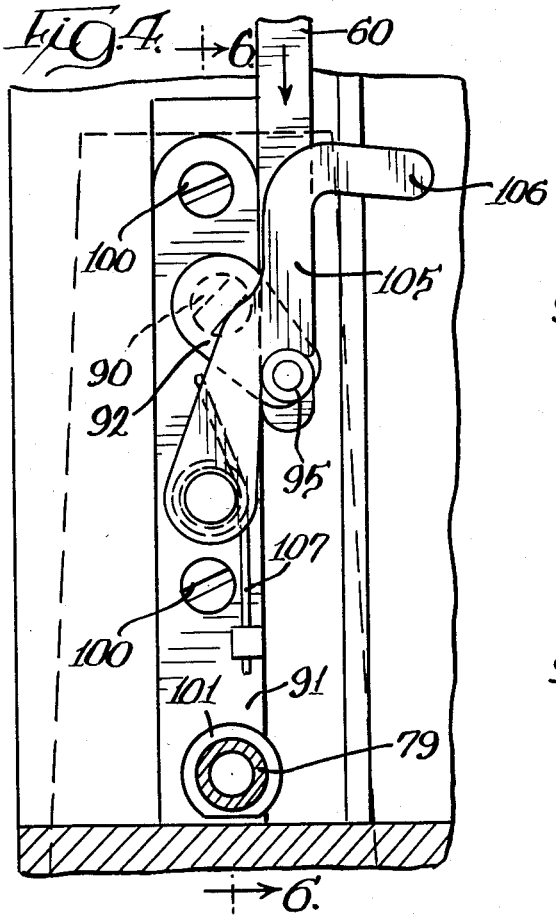
FIG. 4 is a vertical section, taken generally along the line 4—4 in FIG. 3.
Figure 5:
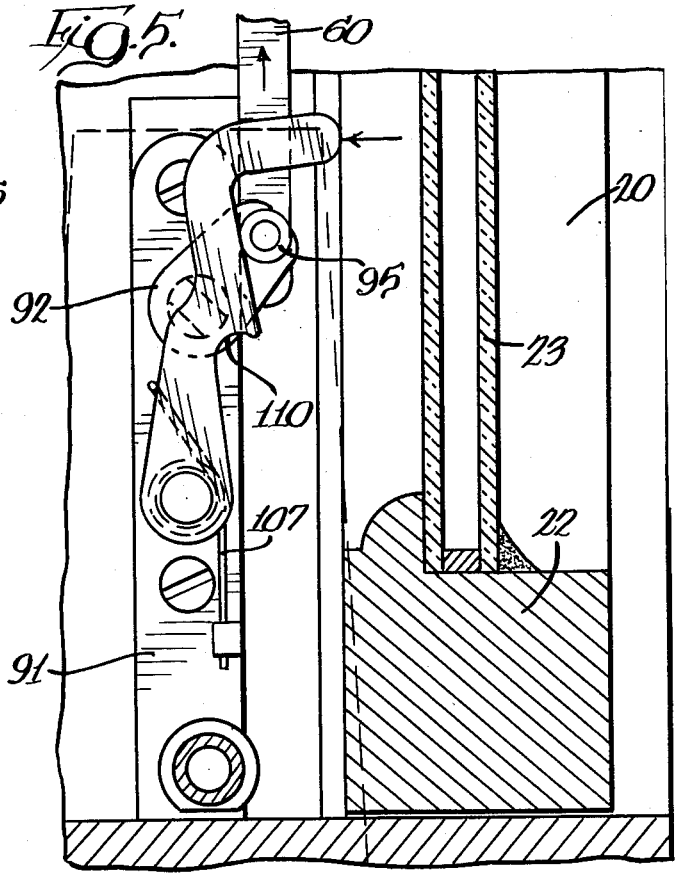
FIG. 5 is a view, similar to FIG. 4, showing the mechanism in position with the window closed.
Figure 6:
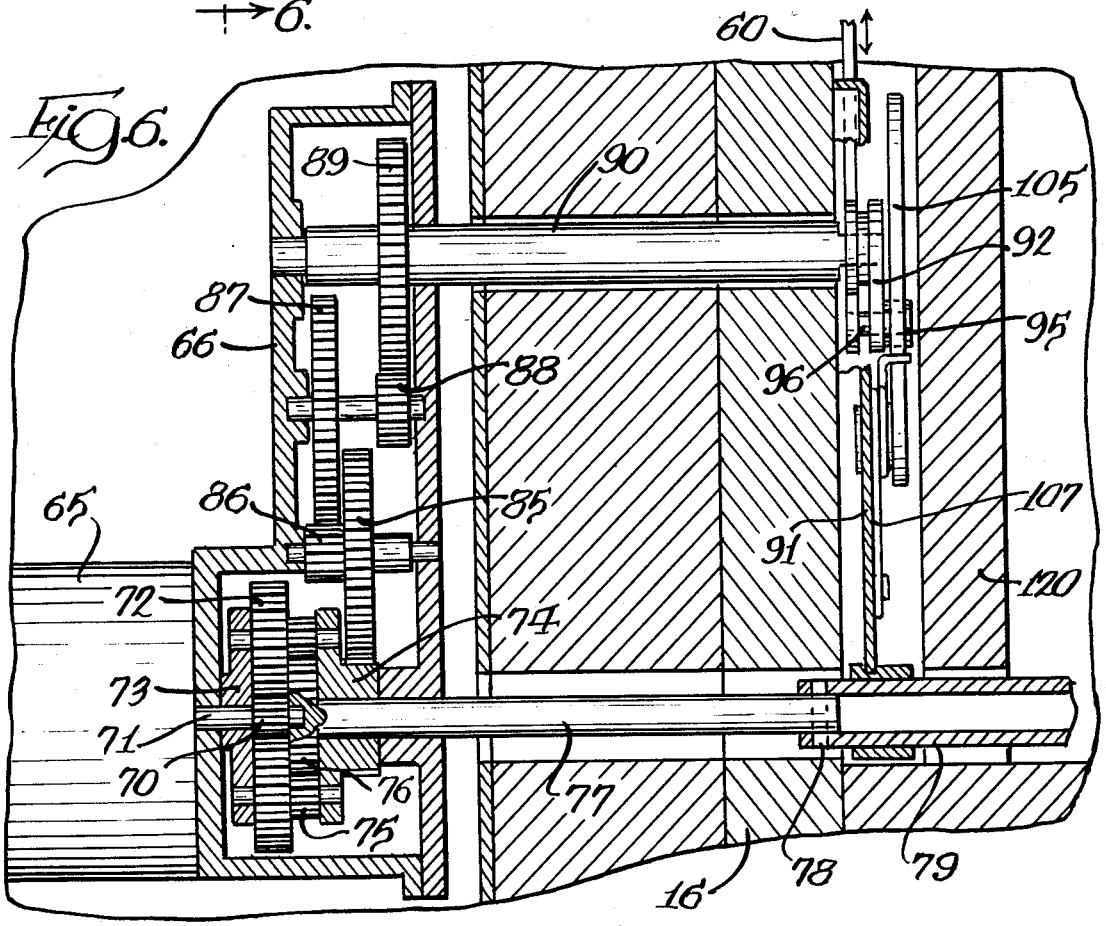
FIG. 6 is a vertical section, taken generally along the line 6—6 in FIG. 4.

Means for locking the window includes a movable tie bar 60, shown particularly in FIGS. 4 to 6. The tie bar 60 has a lower window unlocking position, shown in FIG. 4, and an upper window locking position, shown in FIG. 5. At its upper end, the tie bar has structure for coacting with the window stile 20 for locking of the window. The particular structure for accomplishing the locking does not form part of the invention. However, typically, it can be either a catch member on the window stile which is engaged by a wedge member operatively associated with the upper end of the tie bar or the tie bar can actuate a rotatable member which moves into engagement with a keeper carried on the window stile. A structure of the latter type is shown in U.S. Pat. No. 4,059,298.

The tie bar 60 of the window locking mechanism and the rotatable lead screw 49 of the window operating mechanism are powered in their movement by a power source 65, such as a reversible electric motor, which drives planetary gearing within a gear box 66. It will be obvious that the power source can be air or hydraulic as well as an electric motor. The power source and gear box are of a size to be located within the wall mounting the window and as shown are positioned within an inner wall member 67 and an outer wall member 68. The drive components may be carried by a housing 69 to facilitate positioning within an opening in the wall.

The planetary gearing has a driving sun gear 70 on a shaft 71 which connects to the output of the electric motor 65 and which meshes with the larger diameter sections 72 of multi-diameter planet gears. The planet gears are mounted on a planet gear carrier having spaced-apart plates 73 and 74 which are suitably pinned together to form a rigid structure. Smaller diameter gear sections 75 of the multi-diameter planet gears mesh with a driven sun gear 76 mounted on a shaft 77 which extends outwardly from the gear box 66 and is connected by a flexible connector 78 to a tubular connecting shaft 79 which is connected to a drive end 80 of the rotatable lead screw 49. The planet gear carrier plate 74 has an external gear which meshes with a gear 85 fixed to a smaller diameter gear 86 which are rotatable on a shaft fixed in the gear box. The gear 86 meshes with a gear 87 fixed to an idler shaft carrying a gear 88 which meshes with a gear 89 fixed to a rotatable shaft 90. The rotatable shaft 90 extends through the wall structure and the jamb 16 to a mounting plate 91 which rotatably mounts a throw arm 92 and which is drivingly connected to the shaft 90. The throw arm 92 has at an end thereof a pin extending to opposite sides with a part 95 of the pin defining a catch member and a part 96 of the pin being pivotally connected to the lower end of the tie bar 60. Rotation of the shaft 90 causes rotation of the throw arm 92 for movement of the catch member 95 and pin part 96 between the positions shown in FIGS. 4 and 5.

The mounting plate 91 is attached to the jamb 16 and the tubular drive shaft 79 for the lead screw extends through an opening 101 at the lower end of the mounting plate.

Trigger means are pivotally mounted on the mounting plate 91 and include a trigger member 105 having an end 106 engageable with the window stile 20 when the window is closed and the trigger member is in a first position. Trigger member 105 is shown in such position in FIG. 5 and is urged outwardly to a limit position by a spring 107 whereby, when the window is open, the trigger member assumes the position shown in FIG. 4.

The trigger member 105 has a concavity 110 defining a catch for coaction with the catch member 95, as shown in FIG. 4, whereby, when the trigger member is in its outer limit position, the catch member 95 is caught to hold the tie bar 60 in its lower position which is the unlocked position of the window.

The side jambs 16 and 17 have a pair of stops 120 and 121, respectively, associated therewith and it will be noted, as seen in FIG. 2, that the side stop 120 can be recessed to receive and cover the trigger means with the result that the only part thereof that is visible is the extended trigger member when the window is open.

It will be evident from the foregoing that the planetary gearing has two alternatively operable output connections, with one connected to the rotatable lead screw 49 and the other connected to the throw arm 92 which is structurally connected to the tie bar 60 and powers the raising and lowering movement thereof. With the window closed and locked, the tie bar 60 is positioned as shown in FIG. 5 with the catch member 95 out of engagement with the concavity 110 of the trigger member.

To open the window, the motor 65 is energized in one direction of rotation and the driving sun gear 70 commences rotation. Since the window is locked, there cannot be any rotation of the rotatable lead screw 49 and, thus, the driven sun gear 76 does not rotate. As a result, the planet gear carrier rotates and, through the gear train to the shaft 90, the throw arm 92 is caused to rotate clockwise from the position of FIG. 5 to the position of FIG. 4 to lower the tie bar 60 and unlock the window. During this movement, the trigger member can yield in a counterclockwise direction. The throw arm is prevented against rotating further by pin extension 96 engaging an edge of the mounting plate 91 and, with there then being positive resistance against further rotation of the shaft 90, the planet gear carrier 74 is held against rotation and the driven sun gear 76 commences rotation to rotate the lead screw 49 a sufficient amount to obtain the desired opening of the window and, when such occurs, the motor 65 is deenergized. As the window opens, the trigger member 105 is urged outwardly to its limit position, shown in FIG. 4, and, in such movement, captures the catch member 95.

When it is desired to close the window, the motor 65 is again energized for an opposite direction of rotation. With the catch member 95 caught by the trigger member 105, the throw arm 92 cannot rotate and, therefore, the planet gear carrier 74 does not rotate and the driven sun gear 76 rotates in the opposite direction to rotate the lead screw 49 and close the window. As the window closes, the trigger member is moved to the position of FIG. 5 to release the catch member 95. With the window closed, the lead screw 49 cannot rotate whereby the output connection to the throw arm 92 becomes operative to rotate the throw arm in a counterclockwise direction, as viewed in FIG. 5, and lift the tie bar 60 to lock the window.

It will be obvious to those skilled in the art that other planetary gear arrangements are usable in place of the particular arrangement shown. For example, the driven sun gear 76 could be a ring gear.

From the foregoing, it will be evident that there can be automatic opening and closing as well as locking and unlocking of a window by simply controlling the energization and direction of rotation of a motor and with the mechanism being of a design and a size to be readily mounted on and associated with conventional window and wall structure.

I claim:

1. An automatic operator and locking mechanism for a closure comprising, means connected between the closure and a closure frame operable to open and close the closure, means releasably connectable between the closure and the closure frame for releasably locking the closure in closed position, a power source, gearing connected between the power source and both of said means and having an input means operatively connected to the power source and a pair of output connections operatively continuously connected one to each of said means, said gearing being operable to continuously apply force to both said means and drive the output connection having the least resistance to movement, and trigger means movable by closure contact and responsive to the open or closed position of the closure for controlling the resistance applied to the output connection operatively connected to the means for releasably locking the closure.

2. A mechanism as defined in claim 1 wherein said means connected between the closure and the closure frame operable to open and close the closure comprises a closure hinge mounting the closure for movement, an operator arm operatively connected to the closure, and a lead screw connected to an output connection of the gearing and rotatable to move said operator arm.

3. A mechanism as defined in claim 1 wherein said means for releasably locking the closure comprises a movable tie bar and a throw arm connected to an output connection of the gearing and pivotally connected to said tie bar.

4. A mechanism as defined in claim 3 wherein said trigger means comprises a trigger member movably mounted on the closure frame and having a first position with an end engageable with the closure when the latter is closed, means urging the trigger member toward the closure to a limit position beyond said first position, a catch member movable with the tie bar, and catch means on the trigger member for holding the catch member against movement when the closure is open and the trigger member is in said limit position.

5. A mechanism as defined in claim 1 wherein said gearing comprises planetary gearing.

6. A mechanism as defined in claim 5 wherein said planetary gearing has a pair of sun gears and a planet gear carrier with a plurality of planet gears meshing with each of the sun gears, one of said sun gears being said input means and said planet gear carrier and other sun gear defining said output connections.

7. An automatic operator and locking mechanism for a window comprising, means mounting a window sash in a window frame for pivotal opening and closing movement, means for moving the window sash including an operator arm and a rotatable lead screw connected to said operator arm for moving the operator arm in response to lead screw rotation, means for locking the window sash in closed position including a tie bar movably mounted on the window frame, planetary gearing having two output connections one operatively connected to said lead screw and the other to said tie bar, a power source connected to an input gear of said planetary gearing, trigger means including a movable trigger member engageable by the window sash when the latter is closed and thereby held in a first position and having a second position when the window sash is open, and means on the trigger member coacting with a member movable with the tie bar for holding the tie bar and therefore one output connection of the planetary gearing against movement when the window sash is open and the trigger member is in said second position.

8. A mechanism as defined in claim 7 wherein the two output connections of the planetary gearing can be alternatively driven by the power source, one of said output connections comprising gearing connected to a rotatable throw arm and said throw arm being pivotally connected to said tie bar whereby said planetary gearing moves said tie bar in different directions to both lock and unlock the window sash.

9. An automatic operator and locking mechanism for a casement window or the like comprising, means including a movable member for locking the window, means including a movable member for opening and closing the window, planetary gearing having two alternatively operable output continuously structurally connected through gearing one to each of said members for powering the window open and closed and the movable member of the window locking means in window locking and unlocking movements, and a single power source for said mechanism.

10. A mechanism as defined in claim 9 including trigger means for holding the locking means against movement when the window is open.

11. An automatic operator and locking mechanism for a casement window or the like comprising, means connected between the window sash and a window frame operable to open and close the window sash, means releasably connectable between the window sash and the window frame for releasably locking the window sash in closed position, a single power source for said mechanism, gearing continuously connected between the power source and both of said means and having an input means operatively connected to the power source and a pair of output connections operatively connected one to each of said means, said gearing being operable to drive the output connection having the least resistance to movement, and trigger means pivoted on the window frame and responsive to the open position of the window sash for holding against movement the output connection operatively connected to the means for releasably locking the window sash.

12. A mechanism as defined in claim 11 wherein said means connected between the window sash and the window frame operable to open and close the window sash comprises a window hinge mounting the window sash for movement, an operator arm operatively connected to the window sash, and a lead screw connected to an output connection of the gearing and rotatable to move said operator arm.

13. A mechanism as defined in claim 11 wherein said means for releasably locking the closure comprises a movable tie bar and a throw arm connected to an output connection of the gearing and pivotally connected to said tie bar.

14. A mechanism as defined in claim 13 wherein said trigger means comprises a trigger member movably mounted on the window frame and having a first position with an end engageable with the window sash when the latter is closed, means urging the trigger member toward the window sash to a limit position beyond said first position, a catch member movable with the tie bar and catch means on the trigger member for holding the catch member against movement when the window sash is open and the trigger member is in said limit position.

15. A mechanism as defined in claim 11 wherein said gearing comprises planetary gearing.

16. A mechanism as defined in claim 15 wherein said planetary gearing has a pair of sun gears and a planet gear carrier with a plurality of planet gears meshing with each of the sun gears, one of said sun gears being said input means and said planet gear carrier and other sun gear defining said output connections.

* * * * *

UNITED STATES PATENT AND TRADEMARK OFFICE

CERTIFICATE OF CORRECTION

PATENT NO. : 4,497,135

DATED : Feb. 5, 1985

INVENTOR(S) : GREGORY J. VETTER

It is certified that error appears in the above-identified patent and that said Letters Patent is hereby corrected as shown below:

Column 6, line 37, after "output" insert --connections--.

Signed and Sealed this

*Ninth* Day of *July 1985*

[SEAL]

*Attest:*

DONALD J. QUIGG

*Attesting Officer* *Acting Commissioner of Patents and Trademarks*